United States Patent [19]

Fleissner

[11] 3,934,432

[45] Jan. 27, 1976

[54] APPARATUS FOR THE CONTINUOUS STEAMING OF MAN-MADE FIBERS

[75] Inventor: Heinz Fleissner, Egelsbach near Frankfurt am Main, Germany

[73] Assignee: Vepa AG, Switzerland

[22] Filed: Feb. 27, 1974

[21] Appl. No.: 446,339

Related U.S. Application Data

[62] Division of Ser. No. 276,081, July 28, 1972, Pat. No. 3,838,968.

[30] Foreign Application Priority Data

| | | |
|---|---|---|
| July 28, 1971 | Germany | 2137759 |
| Nov. 16, 1971 | Germany | 2156764 |
| Mar. 11, 1972 | Germany | 2211792 |

[52] U.S. Cl. ..... 68/5 D; 134/105

[51] Int. Cl.[2] ..... D06B 3/02

[58] Field of Search ..... 68/5 D, 5 E; 8/149.3; 134/105; 34/155, 157, 158, 159

[56] References Cited

UNITED STATES PATENTS

| | | | |
|---|---|---|---|
| 3,503,231 | 3/1970 | Fleissner et al. | 68/5 E |
| 3,521,989 | 7/1970 | Angliss et al. | 68/5 D X |

*Primary Examiner*—Harvey C. Hornsby
*Assistant Examiner*—Philip R. Coe
*Attorney, Agent, or Firm*—Craig & Antonelli

[57] ABSTRACT

An apparatus for the continuous steaming, and more specifically shrinking, of fibrous material wherein a fibrous material is transported without tension on conveyor means through absolutely pure and air-free saturated steam within an open steamer housing defining a steam bell, the steam is caused to flow through the material, said saturated steam being produced under said steamer housing and owing to its relatively low specific weight automatically takes the place of the air which in its turn leaves the material owing to its higher specific weight.

22 Claims, 5 Drawing Figures

APPARATUS FOR THE CONTINUOUS STEAMING OF MAN-MADE FIBERS

This is a division of application Ser. No. 276,081 filed July 28, 1972, now U.S. Pat. No. 3,838,968.

The present invention relates to an apparatus for treating — more specifically shrinking — man-made fibers, e.g. crimped synthetic fibers.

It is generally known that optimum shrinkage values are obtained if and when man-made fibers dwell absolutely tensionless in an absolutely air-free saturated steam atmosphere in a steamer. This steamer treatment method has resulted in residual shrinkage values of as little as 1 percent. The achievement of an absolutely air-free steam atmosphere, however, presents a major problem. Even if the steamer is completely filled with steam before it is put into operation, the entering fibrous material will inevitably drag or otherwise introduce a certain volume of air along with it; this air therefore destroys the pure steam atmosphere.

It is the object of the invention to provide an apparatus which permit the steam treatment of the fibrous material without special auxiliary means and at a low steam consumption in an absolutely air-free steam atmosphere which is maintained without the requirement of any special and complicated sealing means.

According to the invention, this object and others are attained by providing at least one hood- or dome-type housing, i.e., a housing having a hermetically joined ceiling and side walls and an open base floor, or bottom portion. At least one sloped conveying installation or means for the fibrous material to be treated enters this dome-shaped housing at its entrance or intake end, and this means is positioned in an upward direction and at the delivery end this means — or some other — sloped conveying installation or means just from the housing in a downward direction. It is also possible that the conveying installation means terminates in front of the rear wall of the housing and overlaps at least one other conveying installation means which is arranged underneath it and protrudes out of the housing. Preferably in the upper section of the dome-type housing steam producing and/or steam supplying means are installed.

One essential advantage of this type of open steaming apparatus is that the air which is contained in the fibrous material to be treated, e.g. the web or the like, can be made to escape from the material only by its own weight, and that the steam in the apparatus may immediately fill the pore spaces within the material which are thereby created. As a consequence, the fibrous material is entirely surrounded and even penetrated by steam without any action or aid from outside the steam housing. Incredible as it may seem, shrinkage values which are thus achieved come near to boiling shrinkage values. Residual shrinkage figures range between 0.1 and 0.4 percent; experts would never have thought such figures could be attainable by a continuous process.

It is another characteristic of the apparatus of this invention that at least one continuously driven conveying installation or means is located in the bottom section of a hood-type or dome-type housing and fills a substantial part of this housing — when the latter, i.e. the housing, is seen in horizontal cross section.

The dome-shaped housing may, for instance, have the form of a rectangular box with rounded edges, i.e., it may consist of two parallel side walls — when seen endwise — and a vaulted top surface formed by an arched roof or like construction.

Steam producing and/or steam supplying means should preferably be located in the top section of the housing and at different heights. In particular such means should be arranged to be adjustable in height and/or to the sides.

It is another feature of the invention that the parallel side walls of the dome-shaped housing stand at each and every point at the same distance from the ground and that the housing walls overlap or rather extend downward beyond the conveying installation or installations which are located in the steamer housing.

The housing can be equipped with an inside and/or outside steam collecting installation such as a conduit or the like. Since the housing is to stand at a certain distance from the ground, stilt supports are provided which may reach into the chamber which the housing walls form and may even extend up to the top.

It is an essential aspect of the invention to provide for receptacles or box-like containers inside the housing which are filled with water and have no lids or covers. Generally known installations such as heating coils or the like serve for heating the water up to its evaporating point to provide steam within the housing.

It is possible to provide for several conveying installations which overlap each other and which run at different speeds; the running speeds should preferably decrease towards the delivery end, i.e., the discharge end of the apparatus.

Another embodiment of the invention relates to a combination of a generally known totally enclosed steaming device with the above-described open steamer which is the subject matter of the present invention.

According to yet another embodiment of this invention, a known totally enclosed steaming device may be used. In this embodiment, it is necessary to provide the floor of this steaming device with openings respectively, to equip the steaming device with a hinged floor plate, and to support the steaming device on stilts or pedestals or the like, at a certain distance from the ground. The opening in the floor can be shut by easily operable means such as flaps, slides, etc.

It is a decisive characteristic of the invention which should be expressly mentioned that the above-described apparatus and the processing phases specified below are suited for steam-treating all types of fibrous material, e.g. for shrinking man-made synthetic fibers as well as for steaming loose stock, tops, tows, knit fabrics, woven fabrics, non-wovens and the like material.

The invention further is concerned with steam conveying installations including fans or the like which are located inside or adjacent to the housing and produce a steam flow through the material to be treated, which is thereby more rapidly heated.

The invention is based on the finding that the material to be treated, especially if it is voluminous, drags a large volume of air into the steaming device and that there already is a certain quantity of air in the housing before the steaming apparatus is started; it is also based on the finding that, since air has a higher specific gravity than steam, the air can be easily caused to flow off in downward direction and that this air flow can be intensified by suction.

In this connection it is advantageous that the natural steam flow through the material and towards the open floor be reinforced by an artificially produced stream — and that at least at the beginning of the steam treatment; the artificial stream must not impair the freedom of movement of the material during shrinkage, for instance, and must not reduce its voluminosity nor create any vorticity in the steam bell formed in the housing. A series of trials showed that a negative pressure of 0.1 to 0.5 mm W. G. — preferably of 0.2 mm W. G. — is most advantageous for this purpose. By this negative pressure which is very low indeed and hardly noticeable, the time required for heating the material up is divided by 5 — as clearly proved by a number of tests. When adjusting the negative pressure, i.e., when creating the artificial stream, care has to be taken that the steam level inside and at the bottom of the steamer hood is not destroyed. In case vortices are produced, this may cause the outside air to enter the steamer hood. In accordance with the process of this invention, the fibrous material usually dwells in the steam atmosphere at saturated steam temperature for approximately one minute — which clearly shows that the heating-up time represents a substantial part of the total steam-treating time.

With an apparatus for steam treating a material in this way it is advantageous to provide for a suction device underneath at least the front portion of the steam-permeable conveying installation, i.e., wire mesh belt or the like, which suction device is connected with a fan with very sensitive control which produces a low negative pressure. This negative pressure leads to a substantial abbreviation of the steaming time without adversely affecting the shrinkage values which would have been achieved without the influence of the fan.

Although it was found that this type of apparatus ensures the achievement of a very low residual shrinkage values, i.e., shrinkage values that are measured after the material has undergone the steam treatment, it was found that the adhesion characteristics of a treated fiber tuft are not always quite satisfactory. Adhesion is defined as the maximum pushing force — relative to the weight per unit of length — which is required to overcome the frictional force prevailing among the individual fibers of a tuft. Therefrom it follows that the adhesion largely depends on a coefficient of friction which on its part is influenced by quite a number of quantities such as the crimp of fibers, the staple length, titre, or the orientation of fibers.

The above-described apparatus not only ensures the abbreviation of the heating-up time but also permits the fibers of the web to shrink simultaneously. It is obvious that, while shrinking simultaneously, the fibers hinder each other in their movement because there necessarily results a certain friction between them. Adhesion could therefore be improved by reducing the friction during shrinkage, e.g., by compensating for the tensions which result from shrinkage.

This problem is solved by freeing the fibers from tensions at least once for a short time during the heating-up phase; this can be done, for instance, by subjecting the fibers to pressure.

The apparatus which conducts this aspect of this process is equipped with a pressure roller at the intake end, inside the steamer hood, which pressure roller is arranged above the conveying installation and compresses the fibers. Depending on the type of fibrous material to be treated, it is also feasible that several pressure rollers in tandem arrangement compress the fibers for a short time. The exact number of pressure rollers to be installed is to be found out by trials.

On having been heated up, i.e., on having been penetrated by steam at a relatively high steam velocity and on having been freed from inherent tensions, the material may then enter into the steam atmosphere in the form of a thicker and more dense layer.

The above-described apparatus is also suited for shrinking crimped staple fibers, and it is also advantageous to use it for shrinking endless, continuous fibers which are thereupon crimped and the crimp of which is finally fixed in a perforated drum machine.

The apparatus of this invention will be further understood from the following detailed description and the accompanying drawings wherein.

Figure 1:
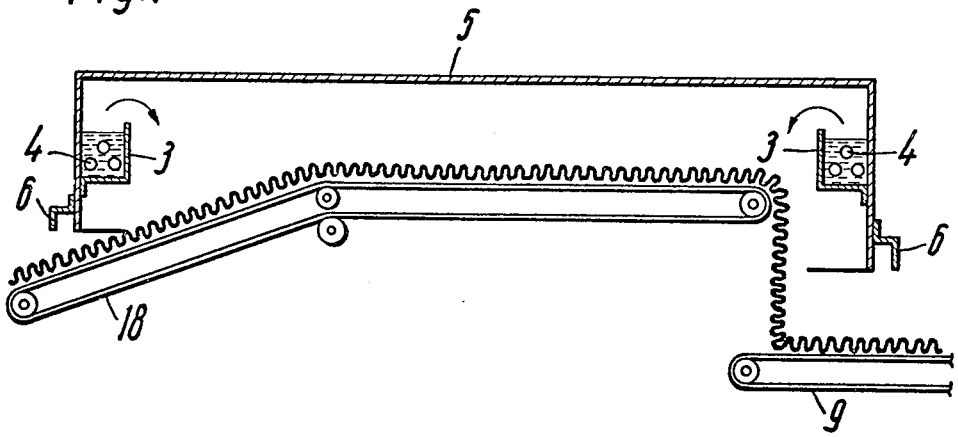
FIG. 1 is a longitudinal section through the steamer hood or housing of this invention.
Figure 4:
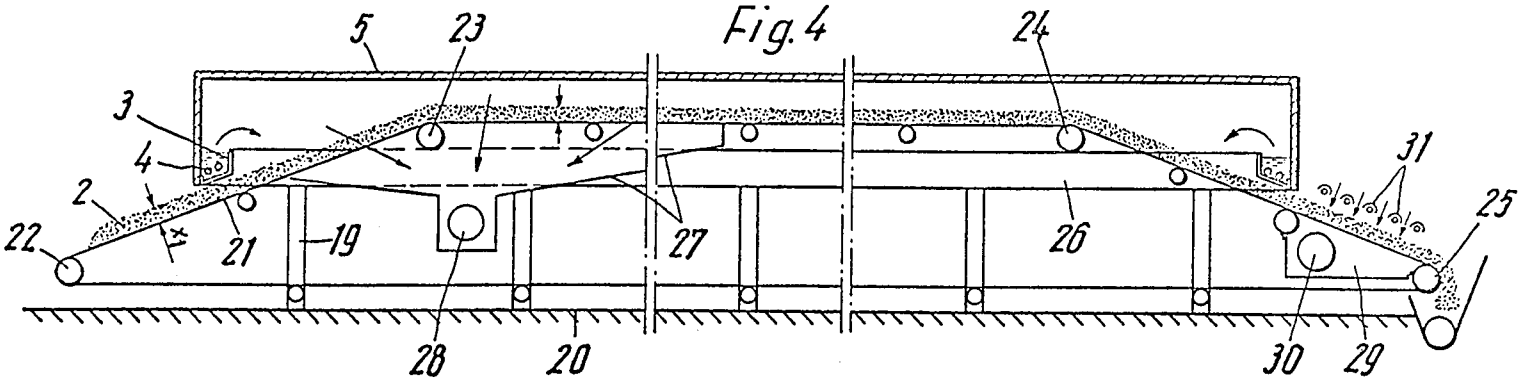
FIG. 4 is a longitudinal section through a steamer hood with a suction unit at the intake end.
Figure 5:
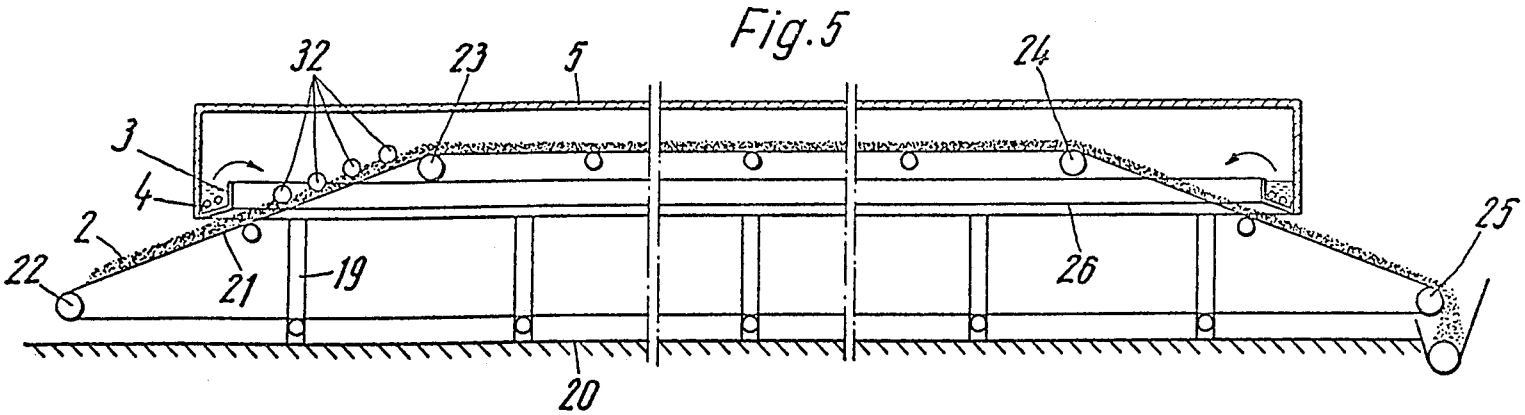
FIG. 5 shows the steamer hood according to FIG. 4 which is equipped with pressure rollers at the intake end.

FIG. 1 shows an open steamer which consists of a dome-shaped housing without base plate in which a steam bell is produced. The fibrous material 2 to be treated is guided into the steam atmosphere by an upward inclined belt conveyor means 18 on which the material then dwells for a certain variable time. As shown in FIGS. 4 and 5, the fibrous material 2 may then be transported downward out of the steamer by the same conveyor means or the material may fall onto another conveyor means 9 which is arranged underneath the first; this second possibility is shown in FIG. 1.

The longitudinal section through the steamer hood 5 in FIG. 1 shows that there is a topless box or open container means 3 provided at the bottom edges of the hood, which box serves as water sump means. The box 3 is continuously filled with water which is heated up to evaporation point by means of heated coils 4, for instance, in which superheated steam is circulated. In this way there is pure saturated steam instead of superheated steam produced in the steamer hood. The steam fills the free space inside the hood 5, and the steam level which is shown by the line 26 in the FIGS. 4 and 5 is maintained constant by laterally positioned exhaust units which, however, are not shown in the drawings.

Since air has a higher specific gravity than steam there normally is the danger of the two gaseous media getting mixed; the heat transfer from the condensing steam to the material would thereby be reduced and the heating-up, shrinking and fixing effects respectively, would be adversely affected. The apparatus according to the invention eliminates this danger.

Figure 2:
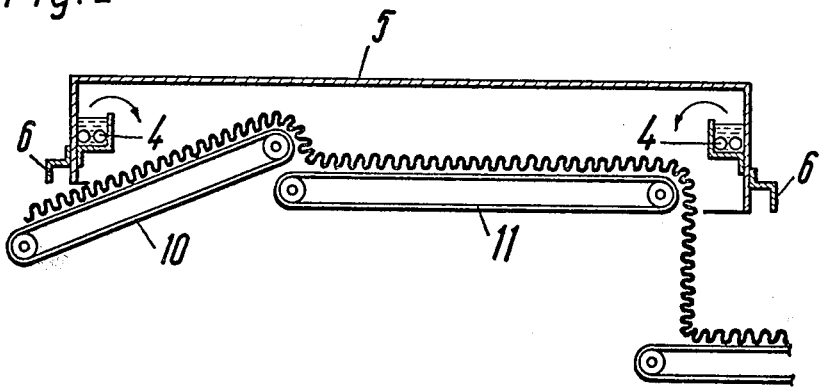
FIG. 2 shows a steamer similar to that shown in FIG. 1 having a different arrangement of the conveying installation or means.
Figure 3:
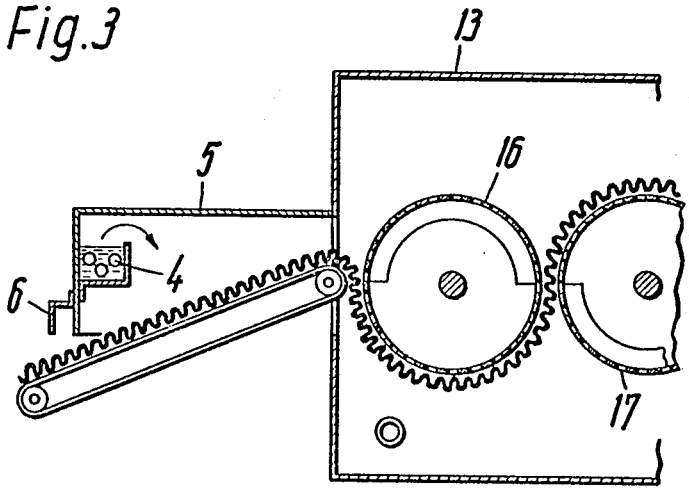
FIG. 3 shows a perforated drum steamer used with a preceding hood- or dome-type steamer.

As shown in FIGS. 1 to 3, there is a collecting conduit 6 installed around the lower edges of the housing hood 5 from which the steam which tends to escape in downward direction from the housing is exhausted by appropriate means so that it does not flow off to the outside atmosphere. Steam generation from the water boxes 3 is preferably controlled in such a way that only the appropriate quantity of steam required for heating the fibrous material and compensating for heat losses is produced plus a small volume of surplus steam which can be exhausted from the collecting conduit 6. This arrangement ensures that there is a pure saturated steam atmosphere inside and down to the lowest part of the housing 5 and that any air which may have been in the steamer or which may have been dragged in by the ingoing fibrous material 2 falls out, i.e., downward from the housing.

FIG. 2 shows an apparatus similar to that shown in FIG. 1, the only difference being that the intake conveyor means 10 is separated from the dwell conveyer means 11 inside the steamer. This provision permits the overfeeding of the material from the intake conveyor onto the dwell conveyor means and consequently, the shortening of the dwell conveyor means.

In principle, any other appropriate type of transporting means, e.g., perforated drums or rollers, can be used for transporting fabrics, webs, etc. through the steamer.

FIG. 3 shows the combination of a totally enclosed steamer 13 with a pre-steamer that is without base plate 5. This pre-steamer is of the dome-type described heretofore and serves for removing the air from the fibrous material 2 which is thereupon guided into the enclosed steamer 13. This combination is advantageous in that the enclosed steamer 13 need not be equipped with a special sealing unit at its intake end because the fibrous material 2 entering it does not contain any air. The housing of the enclosed steamer has only to be provided with an opening near the floor through which the air contained in the steamer itself may be exhausted before operation starts. During actual operation this opening can be shut because there need not be any air removed from the material 2. It is another advantage of the combination of the two steamers that the treatment medium, i.e., the steam may also be circulated respectively superheated; with an open steamer this possibility is restricted because the superheated steam would be cooled down near the open bottom of the steamer and also, because circulated steam would escape from the steamer.

The drawing shows perforated drums 16, 17 which serve as transporting elements inside the enclosed steamer but it is also possible to provide for belt conveyors, rollers, or the like.

The present invention also relates to suction units at the front portion of the steamer, which serve for facilitating the removal of the air displaced by steam from the ingoing material. FIG. 4 shows such a suction unit. The steamer hood 5 is supported on stilts 19, at a distance from the ground 20. An endless wire mesh conveyor 21 passes through the steamer after having been guided in slightly inclined upward direction by the deflector roller 22 at the intake end of the steamer. From the deflector roller 23 inside the steamer hood 5, the conveyor then runs horizontally and is finally deflected downward by the deflector roller 24 and runs towards the roller 25. This provision ensures that the fibrous material 2 which is shown in the drawing to be a web is guided completely tension-free into, through and out of the steam atmosphere. This way of guiding the material has proven best because it guarantees that the material is not subject to any outside force during the steam treatment. The fibers may thus freely shrink down from their initial length $X_1$ to the final length $X_2$. The endless conveyor 21 is guided back to the deflector roller 22 in horizontal direction by the deflector roller 25. As shown, the thickness of the material on the conveyor is thus reduced.

The undisturbed and vorticity-free steam level 26 is a main prerequisite for the proper functioning of the open steamer. To ensure the rapid heating-up of the fibrous material entering the steamer hood, there is a suction unit 27 located underneath the front part of the endless conveyor 21; this suction unit is immediately adjoined to the wire mesh belt 21. The suction unit 27 is combined with a fan 28 the sucking action of which is infinitely variable. By means of this fan 28 and the suction unit 27 there is a very light suction draft, i.e., a slow steam flow towards the fan and through the material 2 is produced. Also, the displaced air is drawn by this draft. The negative pressure which the fan 28 creates must not be too strong in order to prevent any vorticity of the steam in the steam bell and the steam level 26 must not be changed. It is obvious that exact steaming conditions for the various types of material have to be determined by experimentation. It may be said, however, that the negative pressure usually ranges between 0.1 mm and 0.6 mm W. G. in apparatus of the type shown.

FIG. 5 shows an apparatus according to the invention with pressure rollers 32 near the front part of the endless conveyor 21 which rollers compress the web for a short while to remove any tensions which may have been induced during the heating-up period, owing to the shrinkage that takes place at this stage.

This compression permits the fibers to change their position in relation to each other and at the same time any residual air is removed from the web. The roller 32 could be replaced by a pressure belt but the inventor advises against using the belt because of the low steam-permeability of the belt and because the belt hinders the fibers from re-orientation.

The exact location of the pressure roller in the heating-up zone is very important (The first roller is shown positioned approximately at the level of line 26.). The point where the web is first subject to a certain pressure influences the shrinkage. It should in any case be possible to vary the number of rollers and their location in accordance with the type of fibers to be processed.

Behind the delivery end of the steamer hood 5 (which is shown in FIG. 4) and in front of the deflector roller 25 there is a cooling or drying unit installed. If the basically dry material is only to be freed from steam, only the suction fan 30 is put into operation; otherwise the radiators 31 are also switched on so that the sucked-in air is heated before coming into contact with the fibrous material 2.

While the novel embodiments of the invention have been described, it will be understood that various omissions, modifications and changes in these embodiments may be made by one skilled in the art without departing from the spirit and scope of the invention.

What I claim is:

1. An apparatus for the steam treatment of fibrous material which comprises at least one hood-shaped steamer housing that has side walls and is without a base plate, a steam supplying means provided at the side walls, and at least one conveying means for transporting the fibrous material to be treated located partially within said housing whereby the material enters the housing at an intake end and leaves the housing at a delivery end.

2. The apparatus according to claim 1, in which said conveying means includes at least one sloped conveying means which enters the housing at the intake end and another conveying means that leaves the housing at the delivery end, the one conveying means ending inside the housing in front of a rear housing wall and the other conveying means with which the one conveying means overlaps protruding to the outside of said housing.

3. The apparatus according to claim 1, in which said conveying means includes at least one driven conveying means that is arranged in a bottom section of the housing, so that the driven conveying means fills a substantial part of the housing in a horizontal section thereof.

4. The apparatus according to claim 3, in which lower edges of the housing are located the same distance from a support means for said housing and the side walls extend downward beyond the driven conveying means.

5. The apparatus according to claim 1, in which at least one steam collecting means is provided near the lower edges of the housing, at the inside of the housing side walls.

6. The apparatus according to claim 1, in which the steam supplying means includes open boxes inside the steamer housing which are filled with water and equipped with heating coils for generating steam within said housing.

7. The apparatus according to claim 1, in which said conveying means includes several conveyor means which overlap each other in the steamer housing, each of said conveyor means running at different speeds which decrease from the intake end towards the delivery end of the steamer housing.

8. The apparatus according to claim 1, further comprising a conventional steaming device which is enclosed and which is preceded by the steamer housing without a base plate.

9. The apparatus according to claim 8, in which the conventional steamer housing which is enclosed is provided with openings in its base plate and stands at a certain distance from the ground.

10. The apparatus according to claim 9, in which the openings are equipped with easily operable covering means.

11. The apparatus according to claim 1, in which the housing is suspended from a support means.

12. The apparatus according to claim 1, in which the conveying means is a porous and steam-permeable belt, and at least near the intake end of the steamer housing, underneath the conveying means there is a suction unit closely adjoined to the conveying means, which suction unit is combined with a precisely adjustable fan which creates a low negative pressure.

13. The apparatus according to claim 1, in which inside the steamer housing and near the intake end, there is a pressure roller installed above the conveying means for applying pressure to the fibrous material being transported on said conveying means.

14. The apparatus according to claim 13, in which several rollers are installed above and in contact with the conveying means.

15. The apparatus according to claim 13, in which the roller extends across a working width of the conveying means and is arranged at a right angle to the direction of material travel.

16. An apparatus for the steam treatment of fibrous material which comprises at least one open hood-shaped steamer housing defining a steam bell and having an open bottom extending from a material intake end to a material delivery end of the housing, means for supplying steam into said housing, and at least one conveying means for transporting the fibrous material within said housing so that said material extends from below into the intake end of the housing and extends out of the delivery end of the housing at the bottom thereof.

17. The apparatus according to claim 16, in which said means for supplying steam into said chamber comprises water sump means extending along a portion at the bottom of said hood-shaped housing, said water sump means including means for heating water contained therein to produce said steam.

18. An apparatus for the steam treatment of fibrous material which comprises at least one open hood-shaped steamer housing defining a steam bell and having an open bottom extending across the housing, means for supplying steam within said housing, and means for transporting said fibrous material from outside of said housing into the steam contained within said housing and then outside of said housing.

19. An apparatus for the steam treatment of fibrous material which comprises at least one open hood-shaped steamer housing having a bottom open to allow the flow of steam out of said housing extending from a material intake end to a material delivery end of said housing, means for supplying steam within said housing, and conveying means for transporting said fibrous material within said housing from said intake end to said delivery end, said conveying means comprising a steam-permeable conveyor means whereby steam within said housing may flow downwardly through a length of fibrous material and the conveyor means transporting the length of fibrous material to outside of said housing via the bottom of said housing.

20. The apparatus according to claim 19, in which said conveyor means includes a sloped portion that extends upwardly into the intake end, a horizontal portion that extends within the housing and another sloped portion that extends downwardly through the delivery end.

21. The apparatus of claim 19, wherein said conveyor means includes at least one sloped conveyor means which enters the housing at the intake end and another conveyor means that leaves the housing at the delivery ends.

22. The apparatus according to claim 1, in which at least one steam collecting means is provided near the lower edges of the housing, at the outside of the housing side walls.

* * * * *